US010003874B2

(12) United States Patent
Yeh et al.

(10) Patent No.: US 10,003,874 B2
(45) Date of Patent: Jun. 19, 2018

(54) MICROPHONE PACKAGE STRUCTURE

(71) Applicant: LINGSEN PRECISION INDUSTRIES, LTD., Taichung (TW)

(72) Inventors: Yao-Ting Yeh, Taichung (TW); Ming-Te Tu, Taichung (TW)

(73) Assignee: LINGSEN PRECISION INDUSTRIES, LTD., Taichung (TW)

( * ) Notice: Subject to any disclaimer, the term of this patent is extended or adjusted under 35 U.S.C. 154(b) by 0 days. days.

(21) Appl. No.: 15/334,633

(22) Filed: Oct. 26, 2016

(65) Prior Publication Data

US 2018/0063614 A1 Mar. 1, 2018

(30) Foreign Application Priority Data

Aug. 31, 2016 (TW) ..... 105128144 A

(51) Int. Cl.
*H04R 19/04* (2006.01)
*H04R 1/04* (2006.01)
*H04R 1/08* (2006.01)

(52) U.S. Cl.
CPC ..... *H04R 1/04* (2013.01); *H04R 19/04* (2013.01); *H04R 1/083* (2013.01); *H04R 2201/029* (2013.01)

(58) Field of Classification Search
CPC combination set(s) only.
See application file for complete search history.

(56) References Cited

U.S. PATENT DOCUMENTS 9,212,052 B2 * 12/2015 Bolognia ..... H04R 25/604
2013/0193533 A1 * 8/2013 Vos ..... H04R 19/005 257/416
2016/0212548 A1 * 7/2016 Salmon ..... H04R 19/04

* cited by examiner

*Primary Examiner* — Amir Etesam
(74) *Attorney, Agent, or Firm* — Muncy, Geissler, Olds & Lowe, P.C.

(57) ABSTRACT

A microphone package structure includes a substrate, sound wave transducer, processing chip, lid, sound aperture, at least one first solder pad and at least one second solder pad. The substrate has a top side, a bottom side and two opposing lateral sides. The top and bottom sides each connect the lateral sides. The sound wave transducer and processing chip are disposed on the top side. The lid covers the substrate to form a chamber for containing the sound wave transducer and the processing chip electrically connected to the substrate and sound wave transducer. The sound aperture is disposed at the substrate or lid. The at least one first solder pad is disposed on the bottom side and in electrical conduction with the processing chip. The at least one second solder pad is disposed on one of the lateral sides and in electrical conduction with the processing chip.

20 Claims, 4 Drawing Sheets

MICROPHONE PACKAGE STRUCTURE

BACKGROUND OF THE INVENTION

Field of the Invention

The present invention relates to chip packages and, more particularly, to a microphone package structure.

Description of the Prior Art

A conventional microphone package structure is characterized in that a sound wave transducer and a processing chip are electrically connected to a top side of a substrate, and a metal lid covers the top side of the substrate to define a chamber between the substrate and the metal lid so that the sound wave transducer and the processing chip are received in the chamber, wherein a sound aperture corresponding in position to the sound wave transducer is disposed at the top of the metal lid so that sound signals from above the microphone package structure are received by the sound wave transducer through the sound aperture.

The conventional microphone package structure is widely in use with 3C products, such as cell phones. However, the conventional microphone package structure requires that its solder pads be positioned on a bottom side of the substrate. To this end, manufacturers affix the bottom side of the substrate to a PCB substrate by surface mount technology so that the microphone package structure lies flat on the PCB substrate. As a result, the conventional microphone package structure has a drawback, that is, it receives sound signals from above but not laterally.

Accordingly, the conventional microphone package structure has the aforesaid drawback and thus still has room for improvement.

SUMMARY OF THE INVENTION

In view of the aforesaid drawback of the prior art, it is an objective of the present invention to provide a microphone package structure characterized in that its solder pads are disposed on a lateral side and a bottom side of a substrate, wherein a user can selectively position the lateral side of the substrate at an external circuit board or position the bottom side of the substrate at the external circuit board, allowing the microphone package structure to receive sound signals from above or laterally.

The microphone package structure comprises a substrate, a sound wave transducer, a processing chip, a lid, a sound aperture, at least one first solder pad and at least one second solder pad. The substrate has a top side, a bottom side and two lateral sides. The top side and the bottom side each connect the two lateral sides. The two lateral sides are opposite. The sound wave transducer is disposed on the top side. The processing chip is disposed on the top side and electrically connected to the substrate and the sound wave transducer. The lid covers the substrate to form a chamber for containing the sound wave transducer and the processing chip. The sound aperture is disposed at the substrate or the lid. The at least one first solder pad is disposed on the bottom side and in electrical conduction with the processing chip. The at least one second solder pad is disposed on one of the lateral sides and in electrical conduction with the processing chip.

Therefore, depending on structures and features of products, the user selectively positions the bottom side of the substrate at an external circuit board and solders the at least one first solder pad disposed on the bottom side to the external circuit board such that the microphone package structure lies flat on the external circuit board. Alternatively, the user selectively positions one of the lateral sides of the substrate at the external circuit board and solders the at least one second solder pad to the external circuit board such that the microphone package structure is disposed at the external circuit board vertically. Hence, the microphone package structure is variably positioned and thus capable of receiving sound signals from all directions, thereby meeting specific user needs.

DETAILED DESCRIPTION OF THE EMBODIMENT OF THE INVENTION

Figure 1:
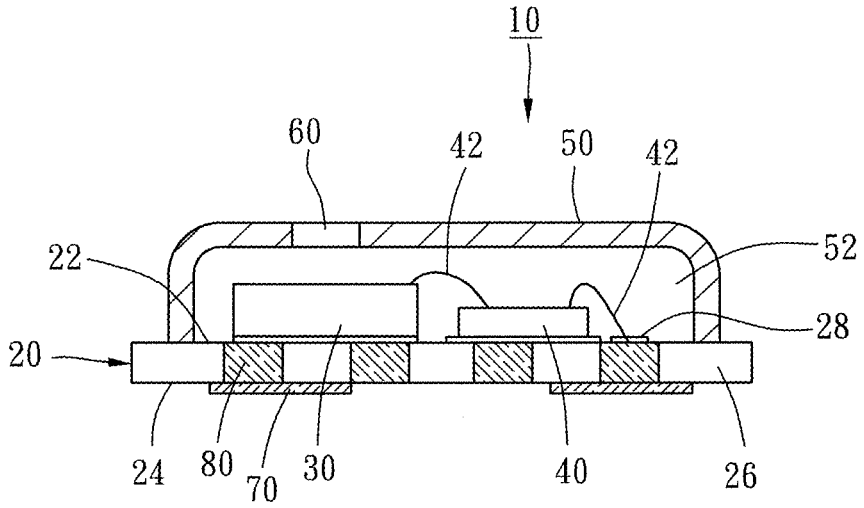
FIG. 1 is a partial cross-sectional view of a microphone package structure according to a preferred embodiment of the present invention.
Figure 2:
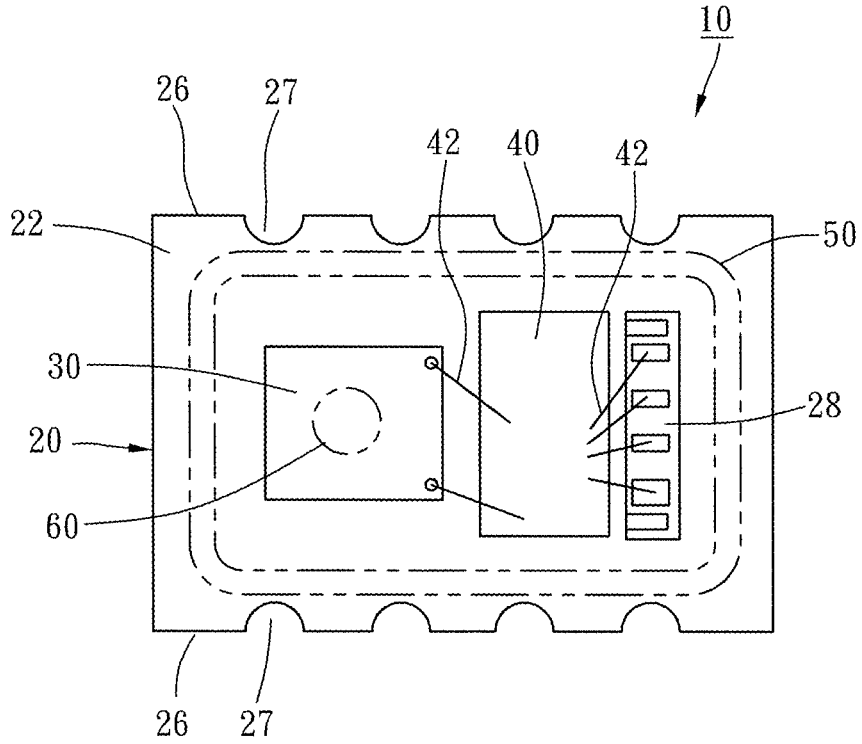
FIG. 2 is a top view of the microphone package structure according to a preferred embodiment of the present invention.
Figure 3:
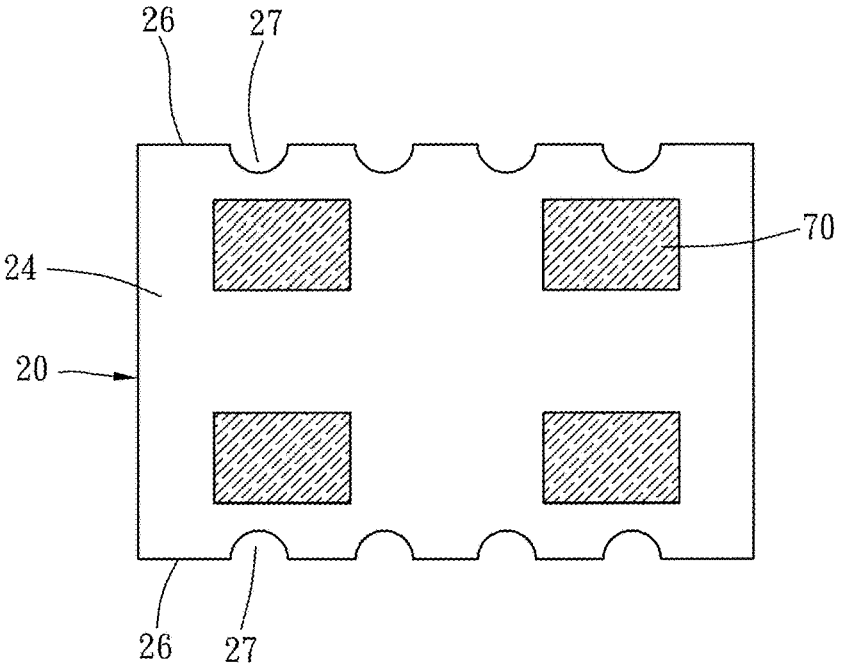
FIG. 3 is a bottom view of the microphone package structure according to a preferred embodiment of the present invention.

Referring to FIGS. 1-3, a preferred embodiment of the present invention provides a microphone package structure 10 which comprises a substrate 20, a sound wave transducer 30, a processing chip 40, a lid 50, a sound aperture 60, at least one first solder pad 70 and at least one second solder pad 80.

The substrate 20 has a top side 22, a bottom side 24, two lateral sides 26 and a conduction portion 28. The top side 22 and the bottom side 24 each connect the two lateral sides 26. The two lateral sides 26 are opposite. The two lateral sides 26 each have at least one groove 27. In this preferred embodiment, the two lateral sides 26 each have four grooves 27, but the present invention is not limited thereto; hence, in another preferred embodiment, only one of the lateral sides 26 has the grooves 27. Each groove 27 is transversely curved and has two ends connected to the top side 22 and the bottom side 24, respectively. The conduction portion 28 is disposed on the top side 22.

The sound wave transducer 30 is disposed on the top side 22 of the substrate 20.

The processing chip 40 is disposed on the top side 22 of the substrate 20. In this preferred embodiment, the processing chip 40 is electrically connected to the sound wave transducer 30 and the conduction portion 28 of the substrate 20 by a wire bonding process with a metal wire 42. In this preferred embodiment, the processing chip 40 is an application-specific integrated circuit (ASIC) designed and manufactured according to specific user needs and a specific electronic system. The processing chip 40 integrates circuits, such as a charge pump, a voltage regulator, an amplifier, a sigma delta modulator and an analog-to-digital converter, thereby achieving advantages, such as being more compact, more robust and capable of suppressing noise.

The lid 50 covers the substrate 20 to form a chamber 52 for containing the sound wave transducer 30 and the processing chip 40. The lid 50 is made of metal, fiberglass or ceramic.

Figure 4:
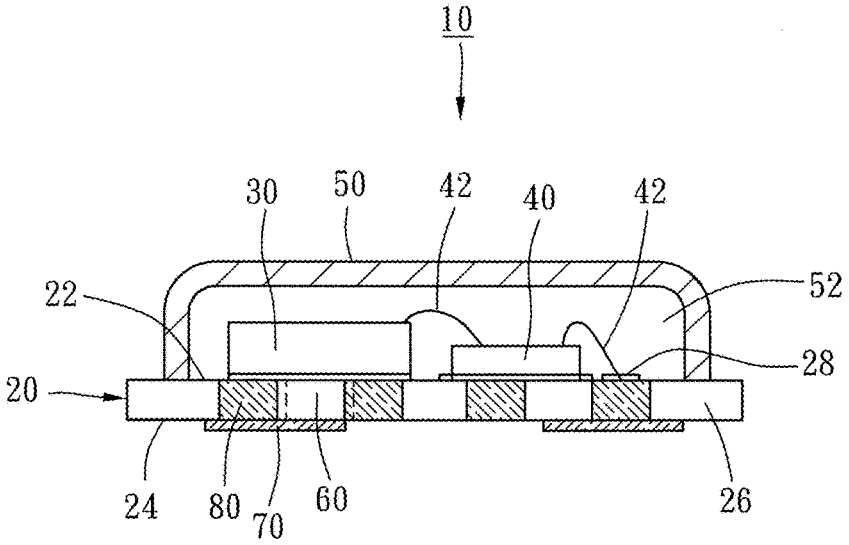
FIG. 4 is a partial cross-sectional view of the microphone package structure according to another preferred embodiment of the present invention, showing a sound aperture disposed on a substrate.

In this preferred embodiment, the sound aperture 60 is disposed at the lid 50 and corresponds in position to the sound wave transducer 30. Referring to FIG. 4, in another preferred embodiment, the sound aperture 60 is disposed at the substrate 20 and corresponds in position to the sound wave transducer 30.

In this preferred embodiment, the at least one first solder pad 70 is in the number of four, but the present invention is not limited thereto. The at least one first solder pad 70 is disposed on the bottom side 24 of the substrate 20. The at least one first solder pad 70 is in electrical conduction with the conduction portion 28 by an internal circuit of the substrate 20.

The at least one second solder pad 80 is disposed in the grooves 27 of the two lateral sides 26. The quantity of the at least one second solder pad 80 is changeable according to the quantity of the grooves 27. The at least one second solder pad 80 is in electrical conduction with the conduction portion 28 through an internal circuit of the substrate 20.

When the microphone package structure 10 is operating, the sound wave transducer 30 receives external sound signals through the sound aperture 60 on the substrate 20 or the lid 50 and converts the external sound signals into electrical signals. Afterward, the electrical signals are sent to the processing chip 40 to undergo a processing process. Upon completion of the processing process, the processed electrical signals are sent through the conduction portion 28 to the at least one first solder pad 70 or the at least one second solder pad 80 and thus can be for use by an external circuit board.

Figure 5:
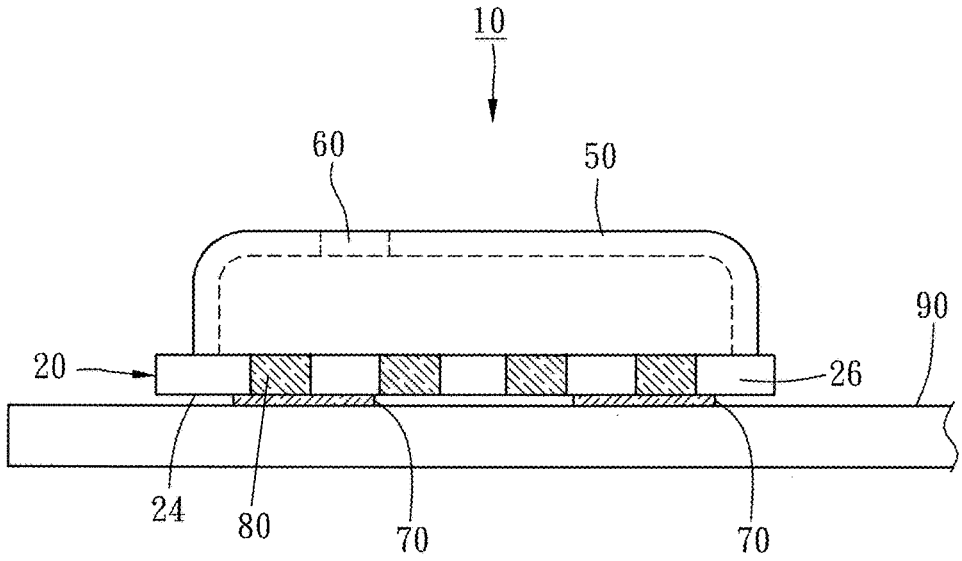
FIG. 5 is a lateral view of the microphone package structure according to a preferred embodiment of the present invention, showing that first solder pads on the bottom side of the substrate are electrically connected to an external circuit board.
Figure 6:
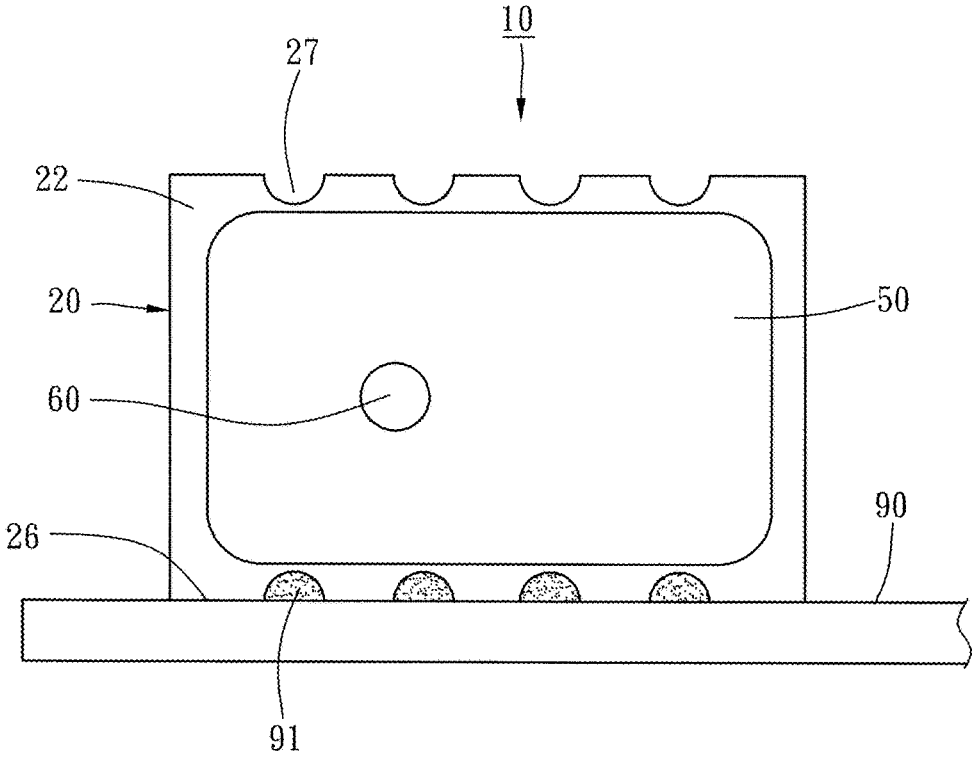
FIG. 6 is a top view of the microphone package structure according to a preferred embodiment of the present invention, showing a solder disposed in a groove such that lateral sides of the substrate are disposed at the external circuit board.
Figure 7:
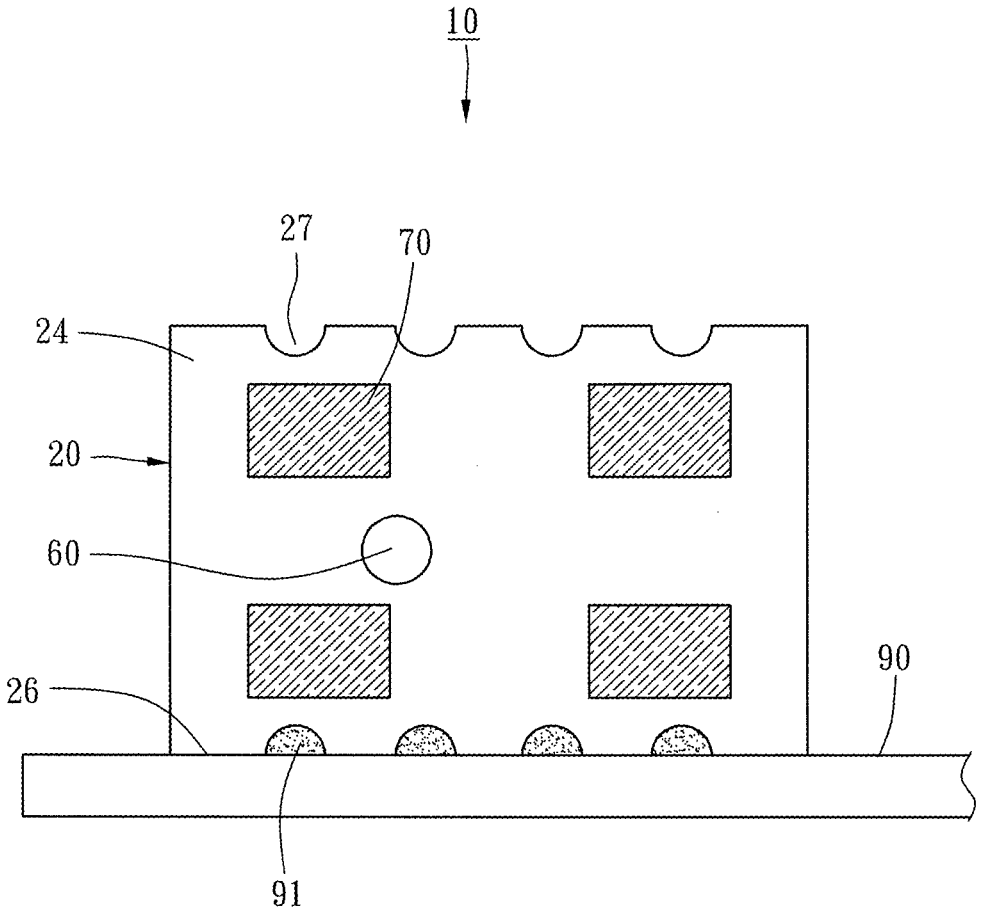
FIG. 7 is a bottom view of the microphone package structure according to another preferred embodiment of the present invention, showing a solder disposed in a groove to position the lateral sides of the substrate at the external circuit board and position the sound aperture at the substrate.

Referring to FIG. 5, depending on structures and features of products, the user selectively positions the bottom side 24 of the substrate 20 at an external circuit board 90 and solders the at least one first solder pad 70 disposed on the bottom side 24 of the substrate 20 to the external circuit board 90 such that the microphone package structure 10 lies flat on the external circuit board 90. Referring to FIG. 6 and FIG. 7, alternatively, the user selectively positions the lateral sides 26 of the substrate 20 at the external circuit board 90 and solders the at least one second solder pad 80 disposed in at least one of the grooves 27 to the external circuit board 90 with a solder 91, so as to bring the following advantages: the microphone package structure 10 is disposed at the external circuit board 90 vertically; and the grooves 27 of the lateral sides 26 provide a large bonding area to the solder 91 for use in soldering and thus increase the bonding strength.

Therefore, depending on structures and features of products, the user selectively positions the microphone package structure 10 at the external circuit board 90 flat or vertically. Moreover, unlike the prior art which resorts to developing different microelectromechanical microphones for use with respective products, the present invention meets specific user needs and incurs low manufacturing costs.

Constituent components and positions thereof disclosed in the above embodiments of the present invention are illustrative rather than restrictive of the scope of the present invention; hence, their replacement by equivalent components as well as their changes are intended to fall within the scope of the appended claims.

What is claimed is:

1. A microphone package structure, comprising:

a substrate having a top side, a bottom side and two lateral sides, wherein the top side and the bottom side each connect the two lateral sides, and the two lateral sides are opposite;

a sound wave transducer disposed on the top side;

a processing chip disposed on the top side and electrically connected to the substrate and the sound wave transducer;

a lid for covering the substrate to form a chamber for containing the sound wave transducer and the processing chip;

a sound aperture disposed on one of the substrate and the lid;

at least one first solder pad disposed on the bottom side and in electrical conduction with the processing chip; and at least one second solder pad disposed on one of the lateral sides and in electrical conduction with the processing chip;

wherein the bottom side of the substrate is positioned at an external circuit board and the at least one first solder pad is soldered to the external circuit board, or the lateral side of the substrate, on which the at least one second solder pad is disposed, is positioned at an external circuit board and the at least one second solder pad is soldered to the external circuit board.

2. The microphone package structure of claim 1, wherein one of the lateral sides has at least one groove transversely curved and having two ends connected to the top side and the bottom side, respectively, and the at least one second solder pad is disposed in the at least one groove.

3. The microphone package structure of claim 2, wherein the at least one groove and the at least one second solder pad are provided in identical plural numbers, and at least one second solder pad is disposed in the grooves, respectively.

4. The microphone package structure of claim 1, wherein the at least one second solder pad is provided in a plural number and disposed on the two lateral sides, respectively, wherein the two lateral sides each have at least one groove transversely curved and having two ends connected to the top side and the bottom side, respectively, and the at least one second solder pad is disposed in the at least one groove of the two lateral sides, respectively.

5. The microphone package structure of claim 1, wherein the substrate further comprises a conduction portion in electrical conduction with the at least one first solder pad and the at least one second solder pad and electrically connected to the processing chip.

6. The microphone package structure of claim 4, wherein the substrate further comprises a conduction portion in electrical conduction with the at least one first solder pad and the at least one second solder pad and electrically connected to the processing chip.

7. The microphone package structure of claim 1, wherein the processing chip is an application-specific integrated circuit (ASIC).

8. The microphone package structure of claim 2, wherein the processing chip is an application-specific integrated circuit (ASIC).

9. The microphone package structure of claim 3, wherein the processing chip is an application-specific integrated circuit (ASIC).

10. The microphone package structure of claim 4, wherein the processing chip is an application-specific integrated circuit (ASIC).

11. The microphone package structure of claim 5, wherein the processing chip is an application-specific integrated circuit (ASIC).

12. The microphone package structure of claim 6, wherein the processing chip is an application-specific integrated circuit (ASIC).

13. The microphone package structure of claim 1, wherein the lid is made of one of metal, fiberglass and ceramic.

14. The microphone package structure of claim 2, wherein the lid is made of one of metal, fiberglass and ceramic.

15. The microphone package structure of claim 3, wherein the lid is made of one of metal, fiberglass and ceramic.

16. The microphone package structure of claim 4, wherein the lid is made of one of metal, fiberglass and ceramic.

17. The microphone package structure of claim 1, wherein the sound aperture corresponds in position to the sound wave transducer.

18. The microphone package structure of claim 2, wherein the sound aperture corresponds in position to the sound wave transducer.

19. The microphone package structure of claim 3, wherein the sound aperture corresponds in position to the sound wave transducer.

20. The microphone package structure of claim 4, wherein the sound aperture corresponds in position to the sound wave transducer.

* * * * *